US008831500B2

(12) United States Patent
Yoshikado et al.

(10) Patent No.: US 8,831,500 B2
(45) Date of Patent: Sep. 9, 2014

(54) MICROWAVE HEATING DEVICE HAVING TRANSFORMER INTERPOSED BETWEEN TUNER AND HEATING CHAMBER

(71) Applicants: Murata Machinery, Ltd., Kyoto (JP); The Doshisha, Kyoto (JP)

(72) Inventors: Shinzo Yoshikado, Kyotanabe (JP); Yoshihiro Shojo, Kyoto (JP); Ryosuke Tahara, Kyoto (JP); Isao Fukuda, Kyoto (JP)

(73) Assignees: Murata Machinery, Ltd., Kyoto (JP); The Doshisha, Kyoto (JP)

( * ) Notice: Subject to any disclaimer, the term of this patent is extended or adjusted under 35 U.S.C. 154(b) by 52 days.

(21) Appl. No.: 13/664,735

(22) Filed: Oct. 31, 2012

(65) Prior Publication Data

US 2013/0108338 A1 May 2, 2013

(30) Foreign Application Priority Data

Oct. 31, 2011 (JP) ..... 2011-238951

(51) Int. Cl.
*G03G 15/20* (2006.01)
*H05B 6/80* (2006.01)
*H05B 6/70* (2006.01)

(52) U.S. Cl.
CPC ..... *H05B 6/708* (2013.01); *H05B 6/80* (2013.01); *H05B 2206/046* (2013.01); *G03G 15/2007* (2013.01)
USPC ..... 399/336; 219/696; 219/693; 219/750; 219/700

(58) Field of Classification Search
USPC ..... 399/336; 219/693, 696, 700, 750; 430/124.4; 427/514
See application file for complete search history.

(56) References Cited

U.S. PATENT DOCUMENTS

| | | | | |
|---|---|---|---|---|
| 4,259,561 | A * | 3/1981 | Roussy et al. | 219/693 |
| 6,909,871 | B2 * | 6/2005 | Behnke et al. | 399/336 |
| 6,938,358 | B2 * | 9/2005 | Lyle et al. | 34/265 |
| 7,092,668 | B2 * | 8/2006 | Behnke et al. | 399/336 |
| 7,127,206 | B2 * | 10/2006 | Morgenweck et al. | 399/336 |
| 7,606,522 | B2 * | 10/2009 | Rohde et al. | 399/336 |
| 2004/0264987 | A1 | 12/2004 | Behnke et al. | |
| 2010/0302318 | A1 | 12/2010 | Onozawa et al. | |
| 2011/0104496 | A1 * | 5/2011 | Cook et al. | 428/404 |
| 2013/0134155 | A1 * | 5/2013 | Yoshikado et al. | 219/690 |
| 2014/0119793 | A1 * | 5/2014 | Yoshikado et al. | 399/336 |

FOREIGN PATENT DOCUMENTS

| | | | |
|---|---|---|---|
| JP | 2003-295692 | | 10/2003 |
| JP | 2003295692 | A | 10/2003 |
| JP | 2004334176 | A | 11/2004 |
| JP | 2009181900 | A | 8/2009 |
| JP | 2010089351 | A | 4/2010 |

* cited by examiner

*Primary Examiner* — Clayton E LaBalle
*Assistant Examiner* — Trevor J Bervik
(74) *Attorney, Agent, or Firm* — DLA Piper LLP (US)

(57) ABSTRACT

A microwave heating device includes a microwave generating portion outputting a microwave, a conductive heating chamber into which the microwave is led and having a short-circuited terminal end in a traveling direction of the microwave, and a tuner provided between the microwave generating portion and the heating chamber. The heating chamber has an opening for passing a member to be heated therethrough. The tuner re-reflects the microwave reflected at the terminal end of the heating chamber onto the heating chamber side. The microwave output end of the microwave generating portion and the tuner are connected by a square tubular waveguide made of a conductive material. The tuner and the terminal end of the heating chamber are connected by a square tubular waveguide, which is made of a conductive material except for the opening for passing the member to be heated therethrough.

12 Claims, 13 Drawing Sheets

| WIDTH OF ELECTRIC FIELD TRANSFORMER [mm] | WAVELENGTH CONVERSION | FRONT-TO-BACK RATIO |
|---|---|---|
| 0 | 0 | 1 |
| 6 | 0.06 λ g' | 1.26 |
| 13 | 0.13 λ g' | 1.79 |
| 25 | 0.25 λ g' | 1.82 |
| 37 | 0.37 λ g' | 1.7 |
| 44 | 0.44 λ g' | 1.1 |
| 50 | 0.50 λ g' | 1 |

MICROWAVE HEATING DEVICE HAVING TRANSFORMER INTERPOSED BETWEEN TUNER AND HEATING CHAMBER

CROSS REFERENCE TO RELATED APPLICATIONS

This application claims the benefit of priority under 35 USC 119 of Japanese application no. 2011-238951, filed on Oct. 31, 2011, which is incorporated herein by reference.

BACKGROUND OF THE INVENTION

1. Field of the Invention

The present invention relates to a microwave heating device with high heating efficiency. The present invention also relates to an image fixing apparatus which uses such microwave heating device with high heating efficiency for fusing developing particles (toner).

2. Description of the Related Art

An image fixing apparatus fuses a toner material onto a sheet (object to be printed) to fix an image onto a sheet. A conventional image fixing apparatus applies heat or pressure onto the sheet by means of a fusing roller to fuse toner onto the sheet.

However, in the conventional configuration, the fusing roller wears with time. As a method for solving such a problem, a non-contact type method for fusing toner with a microwave has been developed in recent years (for example, see JP-A-2003-295692).

FIGS. 10A and 10B are conceptual diagrams showing a configuration of a microwave device disclosed in JPA-2003-295692.

As shown in FIG. 10A, a microwave device 100 includes a magnetron 110 generating a microwave, an input coupling converter 113 which input couples the microwave generated from the magnetron 110 to a resonator chamber 103, a water reservoir 111, and a circulator 112. Between the input coupling converter 113 and the resonator chamber 103, a coupling aperture 114 with a diaphragm is provided. The resonator chamber 103 has a side surface 109 provided with a passing portion 107 for passing and guiding a sheet 101 therethrough. The resonator chamber 103 has on the downstream side a terminal end slider 115 made of metal. The terminal end slider 115 is horizontally movable relative to the resonator chamber 103, and extends into the resonator chamber 103.

FIG. 10B is a schematic perspective view of the resonator chamber 103 portion. A microwave generated from the magnetron 110 is led into the resonator chamber 103. For understanding, FIG. 10B shows the microwave in a substantially sinusoidal wave form.

The resonator chamber 103 has the side surface 109 and a side surface 109' which are opposite to each other and are provided with the passing portion 107 and a passing portion 107', respectively. The sheet 101 passes through the passing portion 107', and is led into the resonator chamber 103. Then, the sheet 101 passes through the passing portion 107 opposite to the passing portion 107', and is ejected therefrom. The moving direction of the sheet 101 is indicated by an arrow.

The passing portions 107 and 107' include therein a movable element 104. The element 104 is a bar made of polytetrafluoroethylene (PTFE), and extends into the resonator chamber 103.

In JP-A-2003-295692, the position of the element 104 can be longitudinally moved in the resonator chamber 103. The position of the element 104 is moved to regulate the resonance conditions in the resonator chamber 103. Therefore, the microwave absorption onto the sheet 101 can be enhanced.

In the technique of JP-A-2003-295692, the coupling aperture 114 with a diaphragm is provided between the input coupling converter 113 and the resonator chamber 103. Thereby, a standing microwave is formed in the resonator chamber 103. However, the diaphragm portion has an inclined side surface which causes microwave reflection, thereby lowering transmission efficiency. That is, to lead a high-energy microwave into the resonator chamber 103, it is necessary to generate higher microwave energy from the magnetron. As a result, the energy consumption is increased.

In the microwave field, it has been known that the temperature of a microwave-exposed sheet is increased. However, in an application in which it is necessary to fuse toner onto a sheet in a very short time in, e.g., a printer and a copy machine, a method which enables temperature increase only for fusing toner in such a short time cannot be established at present. As a typical example of electronic equipment which performs heating with a microwave, e.g., a microwave oven has been known. However, even when a sheet put into an electronic oven is applied with a microwave for one to about several seconds, the temperature of the sheet cannot be increased by 100° C. or more.

In the technique of JP-A-2003-295692, it is difficult to fuse toner in a very short time. In addition, to shorten the fusing time by using the technique, it is necessary to generate very high microwave energy from the magnetron.

SUMMARY OF THE INVENTION

An object of the present invention is to provide a microwave heating device which allows efficient microwave energy transmission to achieve both reduction in energy consumption and improvement in heating efficiency. In addition, an object of the present invention is to provide a non-contact type image fixing apparatus with high heating efficiency by using such a microwave heating device for fusing developing particles.

To achieve the above object, a microwave heating device according to the present invention includes a microwave generating portion outputting a microwave, a conductive heating chamber into which the microwave is led and having a short-circuited terminal end in a traveling direction of the microwave, and a tuner provided between the microwave generating portion and the heating chamber. The heating chamber has an opening for passing a member to be heated therethrough in the heating chamber in a direction non-parallel to the traveling direction of the microwave. The tuner re-reflects the microwave reflected at the terminal end of the heating chamber onto the heating chamber side. The microwave output end of the microwave generating portion and the tuner are connected by a first square tubular waveguide made of a conductive material. The tuner and the terminal end of the heating chamber are connected by a second square tubular waveguide, the waveguide being made of a conductive material except for the opening for passing the member to be heated therethrough.

According to such a configuration, the microwave reflected at the terminal end of the heating chamber is re-reflected onto the heating chamber side by the tuner. Therefore, the microwave can be multi-reflected in the heating chamber. Accordingly, the electric field intensity of the standing microwave in the heating chamber can be higher without significantly increasing microwave energy generated from the microwave generating portion. Therefore, the temperature in the heating chamber can be abruptly increased in a short time.

In the above configuration, the tuner may be an E-H tuner.

With such a configuration, the microwave reflected at the terminal end of the heating chamber can be re-reflected onto the heating chamber side at a very high rate.

In addition to the above configuration, the microwave heating device may further include an electric field transformer which is a high dielectric having a higher dielectric constant than air, the transformer having a width more than $(4N-3)\lambda g'/8$ and less than $(4N-1)\lambda g'/8$ where $\lambda g'$ is the wavelength of a standing microwave in the high dielectric and N (N>0) is a natural number, the transformer being interposed in a position including a node of the standing microwave between the tuner and the heating chamber.

In one configuration, the electric field transformer may have a width which is an odd multiple of $\lambda g'/4$, and be provided such that a surface of the heating chamber on the terminal end side is in a position at the node of the standing microwave.

With such a configuration, the electric field intensity can be higher on the downstream side of the electric field transformer, that is, on the heating chamber side, than on the upstream side. Accordingly, the effect of abruptly increasing the temperature in the heating chamber in a short time can be enhanced.

The electric field transformer may be made of ultra high molecular weight (UHMW) polyethylene.

With such a configuration, the electric field transformer is excellent in processability, and can be relatively inexpensively available. The manufacturers' cost can be reduced.

An image fixing apparatus according to the present invention includes the microwave heating device having the above features, wherein a recording sheet with developing particles passes through the opening and is heated in the heating chamber, thereby fusing the developing particles onto the recording sheet.

With such a configuration, the image fixing apparatus can fuse the developing particles onto the recording sheet in a short time without having any mechanical fusing mechanisms.

According to the present invention, the microwave reflected at the terminal end of the heating chamber is re-reflected onto the heating chamber side by the tuner. Therefore, the microwave can be multi-reflected in the heating chamber. Accordingly, the electric field intensity of the standing microwave in the heating chamber can be higher without significantly increasing microwave energy generated from the microwave generating portion. Therefore, the temperature in the heating chamber can be abruptly increased in a short time.

DETAILED DESCRIPTION OF EMBODIMENTS OF THE INVENTION

[First Embodiment]

Figure 1:
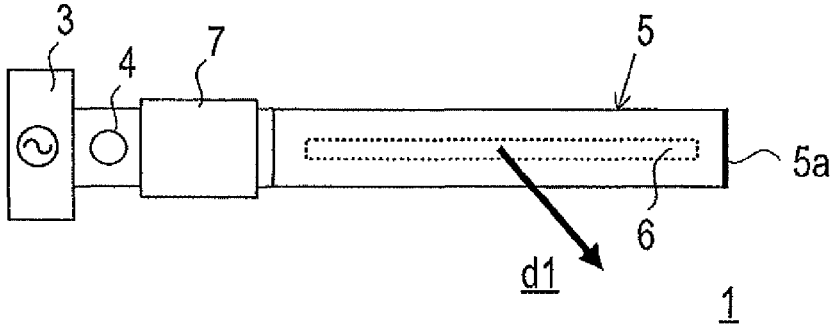
FIG. 1 is a conceptual configuration diagram of a microwave heating device of a first embodiment of the present invention.

FIG. 1 is a conceptual configuration diagram of a microwave heating device according to the present invention, and shows a state seen from one side. A microwave heating device 1 shown in FIG. 1 includes a microwave generating portion 3 which is a magnetron, a heating chamber 5 for heating an object to be heated with a microwave, and a tuner 7 between the microwave generating portion 3 and the heating chamber 5. In addition, in this embodiment, an isolator 4 is provided between the microwave generating portion 3 and the tuner 7. The isolator 4 is a protective device which converts the electric power of the microwave reflected from the tuner 7 in the direction of the microwave generating portion 3 side into heat energy and stably operates the microwave generating portion 3. However, in the device of the present invention, the isolator 4 is not always necessary.

In addition, as shown in FIG. 1, the downstream side of the heating chamber 5 is terminated by a conductor (5*a*). The terminal end 5*a* may be made of the same metal material as the heating chamber 5.

The microwave generating portion 3 and the tuner 7, and the tuner 7 and the heating chamber 5 are connected by square tubular frames made of conductive materials (such as metals), thereby confining the generated microwave. However, the heating chamber 5 has a slit 6 (corresponding to an "opening").

Figure 10A:
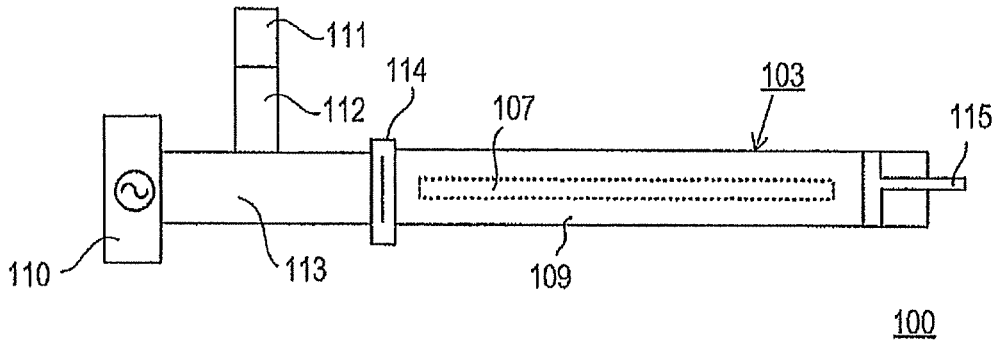
Fig.10A Prior Art
FIG. 10A is a conceptual diagram showing the configuration of a conventional microwave device.
Figure 10B:
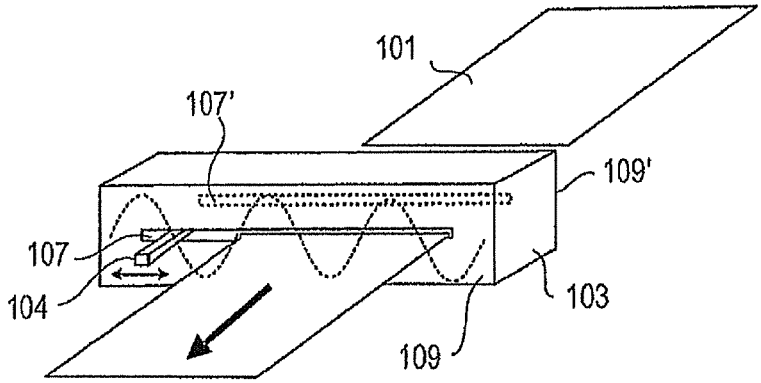
Fig.10B Prior Art
FIG. 10B is a schematic perspective view of a resonator chamber portion of the conventional microwave device.

As in the conventional configuration shown in FIGS. 10A and 10B, in this embodiment, the heating chamber 5 is provided with the slit 6 for passing a sheet (corresponding to a "member to be heated") therethrough. In FIG. 1, the sheet passes from the rear to the front in the direction of arrow d1. That is, the heating chamber 5 also has, in the rear side surface, a slit opposing the slit 6. The sheet enters into the heating chamber 5 through the slit in the rear side surface, is heated in the heating chamber 5, and is ejected from the slit 6 in the front side surface to the outside of the heating chamber 5. Toner particles adhere onto the surface of the sheet. The adherent toner particles are heated in the heating chamber 5, and are fused onto the sheet.

Figure 2:
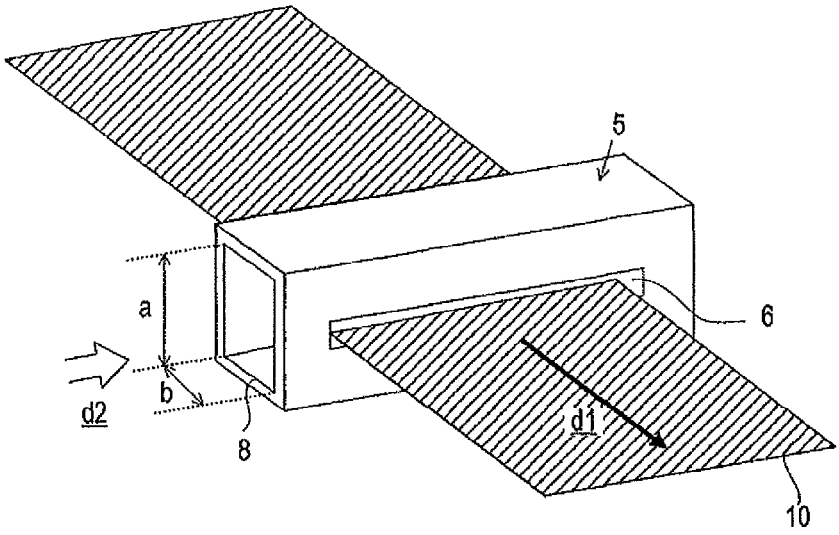
FIG. 2 is a perspective view showing a configuration of a heating chamber.

FIG. 2 is a perspective view showing the configuration of the heating chamber 5. The heating chamber 5 has a square tubular shape such that the periphery thereof is covered with a metal conductor with the slit 6 and a microwave inlet 8 being provided in predetermined surfaces thereof. That is, the heating chamber 5 is short-circuited by the conductor on the surface opposite to the microwave inlet 8, located on the most downstream side seen from the microwave generating portion 3. A constituent material of the heating chamber 5 includes a non-magnetic metal (having almost the same magnetic permeability as magnetic permeability of vacuum) such as aluminum, copper, silver or gold, an alloy having high electric conductivity, one or multi-layered plating having a thickness which is several times as large as a surface skin depth of the above metal or alloy, foil, surface-treated (including coating with a conductive material) metal, alloy such as brass, and resin.

The heating chamber 5 has the microwave inlet 8 in the side surface on the microwave generating portion 3 side. The microwave inlet 8 is an opening for leading a microwave into the heating chamber 5. The microwave outputted from the microwave generating portion 3 is led from the microwave inlet 8 into the heating chamber 5 in the direction indicated by arrow d2. The microwave inlet 8 has a substantially rectangular shape such that a is a dimension perpendicular to advancing direction d1 of a sheet 10 and b is a dimension parallel to d1.

In this embodiment, the microwave propagating in the heating chamber 5 is in the basic mode (H10 mode or TE10 mode).

The slit 6 preferably has a minimum size necessary for passing the sheet 10 to be heated therethrough. This is because when the slit 6 is excessively large, the introduced microwave leaks through the slit 6, and the power of the microwave in the heating chamber 5 may be reduced.

Figure 3:
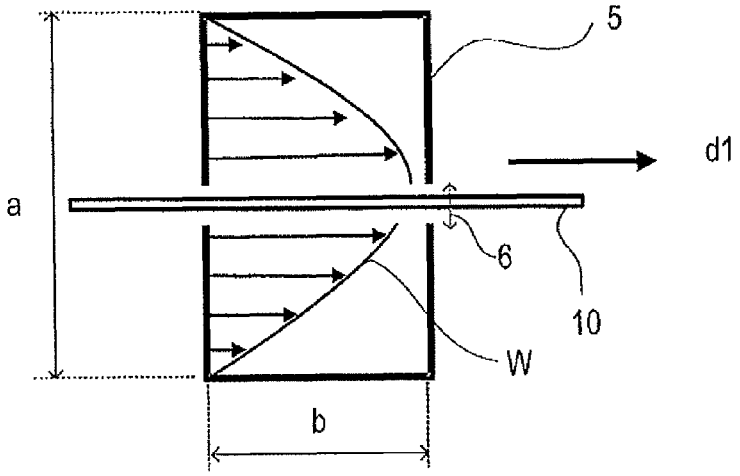
FIG. 3 is a conceptual diagram showing a waveguide electric field distribution when the heating chamber is seen from the traveling direction of a microwave.

FIG. 3 is a conceptual diagram showing a waveguide electric field distribution when the heating chamber 5 is seen from the traveling direction of a microwave. FIG. 3 conceptually shows the electric field intensity of a standing microwave W in the heating chamber 5.

As shown in FIG. 3, the magnitude of the power of the standing microwave W is changed according to the position in the heating chamber 5. The slit 6 is desirably provided in a position in which the power is maximum in the a direction.

Figure 4:
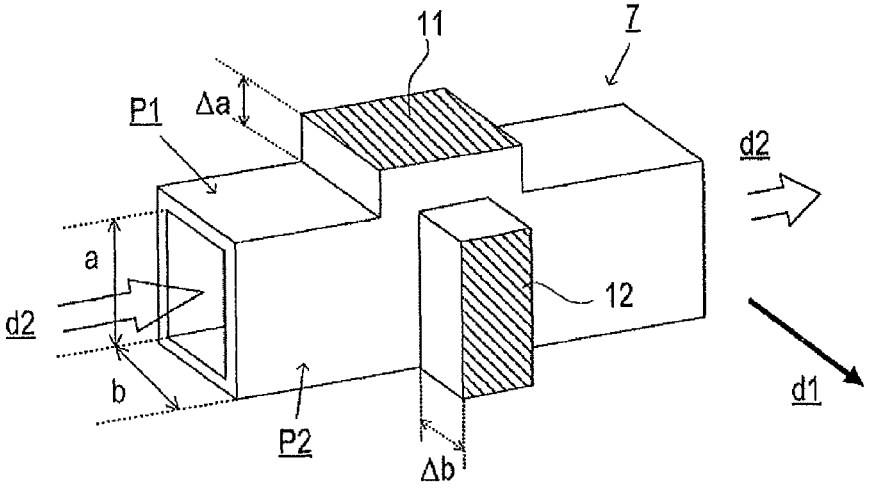
FIG. 4 is a conceptual diagram of a tuner.

FIG. 4 is a conceptual diagram of the tuner 7 in this embodiment. The tuner 7 is a so-called E-H tuner and has two T-shaped branch type projecting portions on the surfaces parallel to the traveling direction d2 of a microwave. That is, in the tuner 7, among the side surfaces of a square tubular waveguide such that the periphery thereof is covered with a metal conductor, a side surface P1 is parallel to the advancing direction d1 of the sheet and has thereon a first T-shaped branch path 11, and a side surface P2 is perpendicular to d1 and has thereon a second T-shaped branch path 12. A constituent material of the tuner 7 includes a non-magnetic metal (having almost the same magnetic permeability as magnetic permeability of vacuum) such as aluminum, copper, silver or gold, an alloy having high electric conductivity, one or multi-layered plating having a thickness which is several times as large as a surface skin depth of the above metal or alloy, foil, surface-treated (including coating with a metal material) metal, alloy such as brass, and resin.

In this embodiment, the tuner 7 which is an E-H tuner is provided between the microwave generating portion 3 and the heating chamber 5. The power of the standing microwave formed in the heating chamber 5 can thus be significantly high. More specifically, an incident microwave is reflected at the terminal end 5*a* of the heating chamber 5, and is then re-reflected onto the heating chamber 5 side by the E-H tuner 7. These reflections are repeated a number of times, so that the electric field intensity of the standing microwave generated in the heating chamber 5 can be higher. Accordingly, time necessary for completely fusing toner can be shortened without significantly increasing the energy of the microwave outputted from the microwave generating portion 3. The detailed results will be described later in Examples.

[Second Embodiment]

Figure 5:
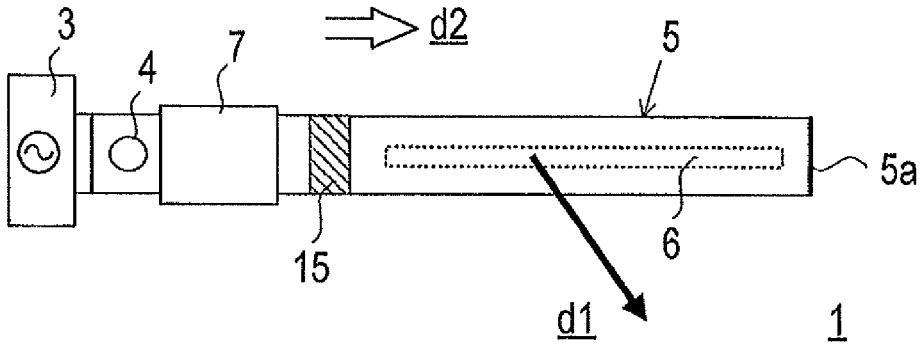
FIG. 5 is a conceptual diagram of a microwave heating device of a second embodiment of the present invention.

FIG. 5 is a conceptual diagram of a microwave heating device according to a second embodiment. Hereinafter, for the d2 direction, the terminal end 5*a* side is called "downstream", and the microwave generating portion 3 side is called "upstream".

This embodiment is different from the first embodiment in that an electric field transformer 15 is further provided on the downstream side (the terminal end 5*a* side) from the tuner 7.

The electric field transformer 15 is made of a high dielectric constant material. In this embodiment, ultra high molecular weight (UHMW) polyethylene is used. However, a resin material such as polytetrafluoroethylene, quartz, and other high dielectric constant materials can be used. In addition, the electric field transformer 15 is preferably made of a hard-to-heat material where possible. From the viewpoint of the processability and the cost, UHMV polyethylene is preferably used.

The electric field transformer 15 has a width in the traveling direction d2 of a microwave which is an odd multiple of $\lambda g'/4$ ($\lambda g'/4$, $3\lambda g'/4$, . . . ) where $\lambda g'$ is the wavelength of a standing microwave formed in the same dielectric as the electric field transformer 15 (hereinafter, called a "dielectric wavelength"). The electric field transformer 15 has a width which is an odd multiple of $\lambda g'/4$, so that the interposition effect of the electric field transformer 15 can be the highest. However, the interposition effect of the electric field transformer 15 can be obtained by setting the width of the electric field transformer 15 to satisfy later-described relational equations.

When $\lambda$ is the wavelength of a microwave generated from the microwave generating portion 3, $\in'$ is the dielectric constant of the electric field transformer 15, $\lambda c$ is a cut-off wavelength, and λg' is a dielectric wavelength, Equation 1 is established. From this relational equation, dielectric wavelength λg' can be calculated.

$$\frac{1}{\lambda^2} = \frac{\varepsilon'}{\lambda_g'^2} + \frac{1}{\lambda_c^2} \quad \text{[Equation 1]}$$

Figure 6:
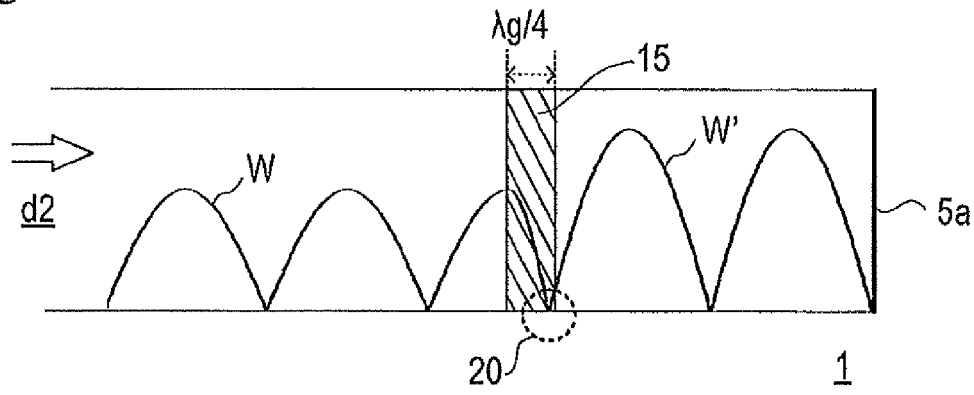
FIG. 6 is a conceptual diagram showing a waveguide electric field distribution when an electric field transformer is provided.

As shown in FIG. 6, in this embodiment, the electric field transformer 15 is fixed. More specifically, the electric field transformer 15 is provided in a position 20 which is a node of a standing microwave formed in the heating chamber 5. More specifically, the electric field transformer 15 is provided in the position 20 in which the surface of the electric field transformer 15 on the terminal end 5*a* side (downstream side) is at the node.

The electric field transformer 15 has a higher dielectric constant than air, so that the wavelength of the standing microwave passing in the electric field transformer 15 becomes short. Accordingly, the electric field intensity of a standing microwave W' on the downstream side (the terminal end 5*a* side) from the electric field transformer 15 can be higher. In particular, when a width L of the electric field transformer 15 is set within the range of the following relational equation, the electric field intensity of standing microwave W' can be significantly higher. In the following relational equation, N is a natural number.

$$(4N-3)\lambda g'/8 < L < (4N-1)\lambda g'/8 \quad \text{(Relational equation)}$$

These results will be apparent by later-described Examples.

As in the first embodiment and this embodiment, in the configuration generating the standing microwave in the heating chamber 5, a high electric field intensity portion (antinode) and a low electric field intensity portion (node) are caused according to distance in the direction from the terminal end 5*a* toward the microwave generating portion 3. As shown in FIG. 6, in particular, by providing the electric field transformer 15 at the node of the standing microwave, the electric field intensity of standing microwave W' on the downstream side from the electric field transformer 15 can be higher. The toner fusibility can thus be improved.

That is, the slit 6 is provided on the downstream side from the electric field transformer 15 to pass the sheet 10 therethrough, thereby performing heating treatment based on power-increased standing microwave W'. The toner fusing time can be further shortened.

By providing the electric field transformer 15, the electric field intensity on the downstream side therefrom can be higher, which is also supported by the following theory.

(Description of the Theory)

Figure 7A:
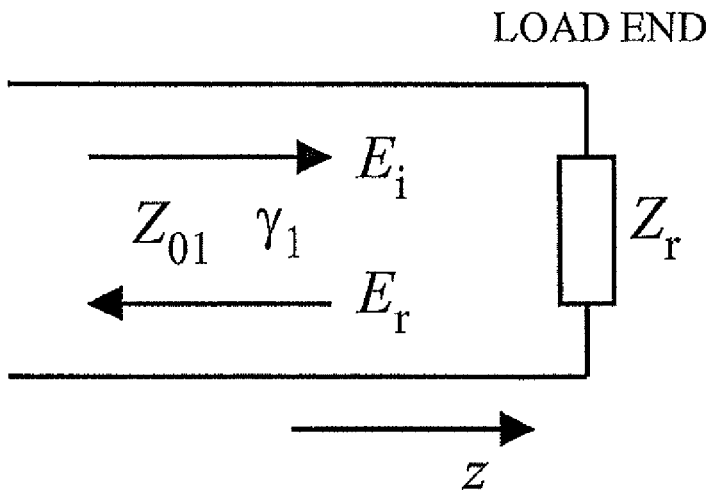
FIG. 7A is a conceptual diagram for describing a waveguide electric field state when a terminal end of a waveguide is short-circuited.

As shown in FIG. 7A, the load end of the rectangular waveguide is terminated with an impedance $Z_r$. When in consideration of the $TE_{10}$ mode, $E_i$ is the amplitude of an incident electric field intensity at the load end and $E_r$ is the amplitude of a reflected electric field intensity at the load end, $E_y$ and $H_x$ at points on the Z axis of the waveguide are expressed by Equation 2. The a direction in FIG. 2 corresponds to the X axis, the b direction therein corresponds to the Y axis, and the d2 direction therein corresponds to the Z axis. $E_y$ corresponds to the Y axis component of an electric field, and $H_x$ corresponds to the X axis component of a magnetic field.

$$\begin{aligned} E_y &= E_i e^{-\gamma_1 z} + E_\gamma e^{\gamma_1 z} \\ H_x &= H_i e^{-\gamma_1 z} - H_\gamma e^{\gamma_1 z} \\ &= \frac{1}{Z_{01}}(E_1 e^{-\gamma_1 z} + E_\gamma e^{\gamma_1 z}) \end{aligned} \quad \text{[Equation 2]}$$

In Equation 2, $Z_{01}$ is a characteristic impedance, and $\gamma_1$ is a propagation constant.

Figure 7B:
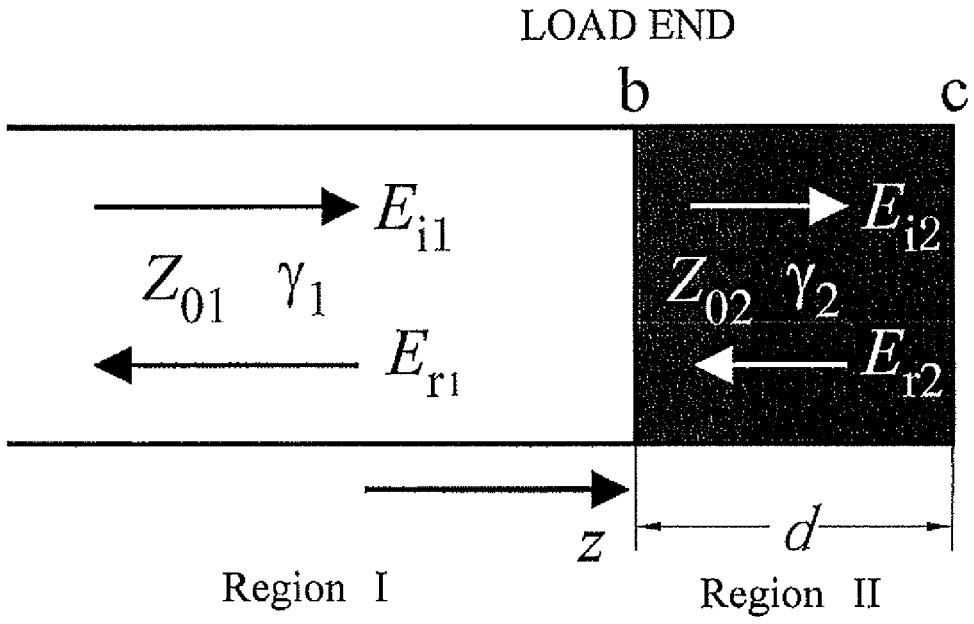
FIG. 7B is a conceptual diagram for describing a waveguide electric field state when the terminal end of the waveguide is filled with a material having a different dielectric constant.

Here, as shown in FIG. 7B, a region I includes an atmosphere, and a region II is filled with the dielectric short-circuited at a terminal end c as an impedance $Z_R$. When $E_{i1}$ is the incident electric field intensity of the region I, $E_{r1}$ is the reflected electric field intensity of the region I, $E_{i2}$ is the incident electric field intensity of the region II, and $E_{r2}$ is the reflected electric field intensity of the region II, Equation 3 is established by Equation 1 and under the boundary conditions at z=0.

$$\begin{aligned} E_{i1} + E_{r1} &= E_{i2} + E_{r2} \\ H_{i1} - H_{r1} &= \frac{1}{Z_{01}}(E_{i1} - E_{r1}) \\ &= \frac{1}{Z_{02}}(E_{i2} - E_{r2}) \end{aligned} \quad \text{[Equation 3]}$$

Here, since in FIG. 7B, the surface of terminal end c is short-circuited, Equation 4 is established. The Z coordinate in the head position (on the microwave generating side) in the region II is 0, and the width of the region II in the Z axis direction is d.

$$E_x(z=d) = E_{i2}e^{-\gamma_2 d} + E_{\gamma 2}e^{\gamma_2 d} = 0 \quad \text{[Equation 4]}$$

When Equation 4 is solved for $E_{i2}$, Equation 5 is established.

$$\begin{aligned} \frac{E_{i2}}{E_{i1}} &= \frac{-2Z_{02}e^{-\gamma_2 d}}{Z_{02}(e^{\gamma_2 d} - e^{-\gamma_2 d}) + Z_{01}(e^{\gamma_2 d} + e^{-\gamma_2 d})} \\ &= 0 \end{aligned} \quad \text{[Equation 5]}$$

In Equation 5, when the loss is neglected to take the absolute values, Equation 6 is established.

$$\begin{aligned} \left|\frac{E_{i2}}{E_{i1}}\right| &= \left|\frac{E_{r2}}{E_{r1}}\right| \\ &= \left\{1 + \left[\left(\frac{\beta_{2g}}{\beta_{1g}}\right)^2 - 1\right] cos^2(\beta_{2g}d)\right\}^{\frac{1}{2}} \\ &= [I + (K^2 - I)cos^2(\beta_{2g}d)]^{\frac{1}{2}} \end{aligned} \quad \text{[Equation 6]}$$

In Equation 6, $\beta_{1g}$ is a complex component (phase constant) of a waveguide wavelength $\lambda_{1g}$ in the region I, and $\beta_{2g}$ is a complex component (phase constant) of a waveguide wavelength $\lambda_{2g}$ in the region II. In addition, K is a constant.

From Equation 6, when $\beta_{2g}d$ is an odd multiple of π/2, the electric field intensity of the region II is equal to the incident electric field intensity, and when $\beta_{2g}d$ is an even multiple of π/2, the electric field intensity of the region II is 1/K of the incident electric field intensity. When the boundary surface between the regions having different dielectric constants is at the antinode of the electric field, the electric field intensities of the regions on both sides of the boundary surface are equal, When the boundary surface between the regions having different dielectric constants is at the node of the electric field, the electric field intensities of the regions on both sides of the boundary surface are inversely proportional to the ratio between phase constants $\beta_g$ of the regions.

Figure 7C:
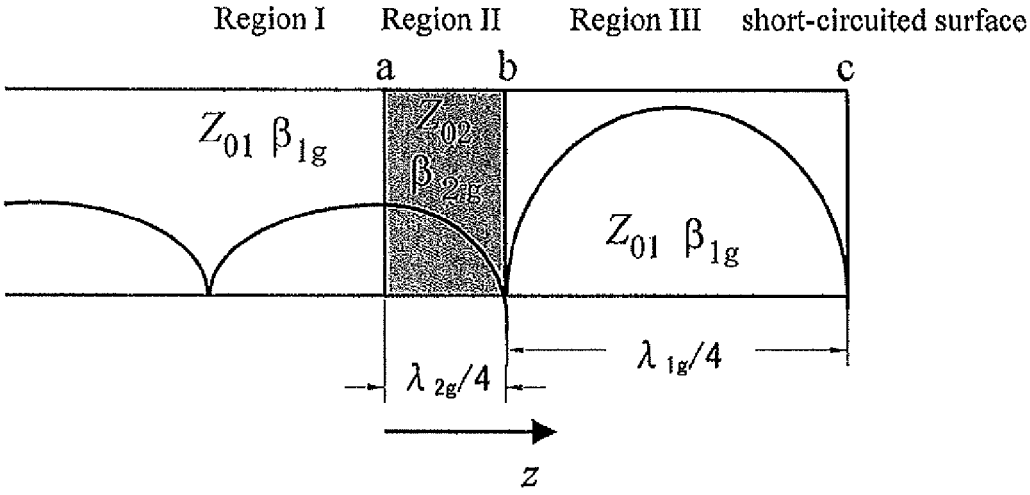
FIG. 7C is a conceptual diagram for describing electric field states on the upstream from the dielectric, within the dielectric, and on the downstream from the dielectric when the waveguide is filled with a material having a different dielectric constant.

Therefore, as shown in FIG. 7C, the waveguide is filled with the dielectric having a thickness of $\lambda_{2g}/4$ on the downstream side from a reference surface a (region II), and a short-circuited surface c is then placed at the distance of $\lambda_{1g}/4$ on the downstream side of the region II from b (region III). Equation 7 is thus established. $E_I$, $E_{II}$, and $E_{III}$ indicate electric field intensities in the regions I, II, and III, respectively.

$$\left|\frac{E_{III}}{E_{II}}\right| = \left|\frac{\beta_{2g}}{\beta_{1g}}\right| = K \quad \text{[Equation 7]}$$

In consideration of the condition $|E_I|=|E_{II}|$, Equation 8 is established.

$$|E_{III}|-K|E_I \quad \text{[Equation 8]}$$

From Equation 8, the electric field intensity of the region III is K times the electric field intensity of the region I. That is, by interposing the dielectric having a thickness of $\lambda_{2g}/4$, that is, the electric field transformer 15, the electric field intensity on the upstream side therefrom is amplified to be propagated to the downstream side.

When the region I includes an atmosphere and the region II includes the dielectric having a dielectric constant $\in_r$, the constant K is defined by Equation 9.

$$K = \frac{\beta_{2g}}{\beta_{1g}} = \left[\frac{\varepsilon_r - \left(\frac{\lambda}{2a}\right)^2}{1 - \left(\frac{\lambda}{2a}\right)^2}\right]^{\frac{1}{2}} \quad \text{[Equation 9]}$$

[Other Embodiments]

<1> In the embodiments, the microwave is used for fusing toner onto the sheet. However, the present invention can be used for other typical applications in which abrupt heating is required in a short time (e.g., calcination and sintering of ceramics, chemical reaction requiring high temperature, and manufacturing of a wiring (conductive) pattern with toner as metal particles).

<2> In the second embodiment, the width of the electric field transformer 15 is preferably an odd multiple of $\lambda g'/4$. However, the width of the electric field transformer 15 should satisfy at least the relational equations, and is desirably close to an odd multiple of $\lambda g'/4$ where possible. When the width of the electric field transformer 15 is an even multiple of $\lambda g'/4$, impedance conversion is not performed. Therefore, the effect of increasing the electric field intensity on the later stage (terminal end 5*a*) side cannot be exhibited.

Most preferably, the surface of the electric field transformer 15 on the terminal end 5*a* side is in the position at the node of the standing microwave, but should be in at least a non-antinode position.

<3> In the embodiments, the heating chamber 5 has the slit 6 as the opening. However, the opening is not limited to have the slit shape. For example, the opening may be circular, square, and polygonal. In particular, when the member to be heated is in a sheet form, such as paper and a cloth, the opening preferably has the slit shape. When the member to be heated is in a linear form such as a thread, the opening is preferably circular, square, and polygonal.

EXAMPLES

First Example

Hereinafter, the experimental results of Examples and Comparative Example by assuming the configurations of the embodiments are shown. In Examples and Comparative Example, the following devices are commonly used.

The microwave generating portion 3: A product manufactured by MICRO DEVICE CO. LTD (at present, MICRO ELECTRO CO. LTD) is used. As the generating conditions, an output energy is 400 W, and an output frequency is 2.45 GHz.

The isolator 4: A product manufactured by MICRO DEVICE CO. LTD (at present, MICRO ELECTRO CO. LTD) is used.

The heating chamber 5: An aluminum waveguide provided with the slit 6

The sheet 10: A commercially available PPC (Plain Paper Copier) sheet called neutralized paper is used.

Example 1

As the tuner 7, an E-H tuner (a product manufactured by MICRO DEVICE CO. LTD (at present, MICRO ELECTRO CO. LTD) is used. The heating chamber 5 has dimensions of a=109.2 mm and b=54.6 mm. The electric field transformer 15 is not provided. When the E-H tuner is used in Examples and Comparative Example, the same E-H tuner is used.

Example 2

As the tuner 7, the E-H tuner is used. The heating chamber 5 has dimensions of a=109.2 mm and b=54.6 mm. As the electric field transformer 15, UHMW polyethylene (dielectric constant $\in_r$=2.3) is used. More specifically, in the heating chamber 5, UHMW polyethylene having a width of 25 mm is interposed from the position at a distance of 500 mm from the terminal end 5*a* toward the upstream side.

Example 3

This example has the same conditions as Example 1 except that the heating chamber 5 has dimensions of a=70 mm and b=54.6 mm. However, the size of the E-H tuner is different from the size of the heating chamber 5. Therefore, the tuner 7 and the heating chamber 5 are connected by a taper-shaped waveguide.

Example 4

This example has the same conditions as Example 2 except that the heating chamber 5 has dimensions of a=70 mm and b=54.6 mm. However, from the same reason as Example 3, the tuner 7 and the heating chamber 5 are connected by a taper-shaped waveguide.

Example 5

This example has the same conditions as Example 1 except that as the tuner 7, an iris (a product manufactured by MICRO DEVICE CO. LTD (at present, MICRO ELECTRO CO. LTD) is used.

Comparative Example 1

This example has the same conditions as Example 1 except that the tuner is not provided.

Under the respective conditions, the sheet 10 with toner put on a predetermined region thereof is set into the slit 6 of the heating chamber 5 to measure time required for fusing the toner. Then, the measured time is multiplied by the ratio between the area of the predetermined region and the area of an A4 sheet to calculate time for toner fusion onto the A4 sheet. Table 1 shows the results.

TABLE 1

| | Example 1 | Example 2 | Example 3 | Example 4 | Example 5 | Comparative Example 1 |
|---|---|---|---|---|---|---|
| Time for fusion onto A4 sheet (seconds) | 24 | 14 | 17.3 | 11.6 | 24 | Longer than 120 seconds |

When the tuner is not provided, it is difficult to fuse the toner onto the A4 sheet even after the elapse of 120 seconds. On the contrary, in Examples 1 to 5 in which the tuner 7 is provided, the toner is fused in time significantly shorter than 120 seconds. Accordingly, by providing the tuner 7, the power of the standing microwave formed in the heating chamber 5 can be significantly increased.

Second Example

Figure 8:
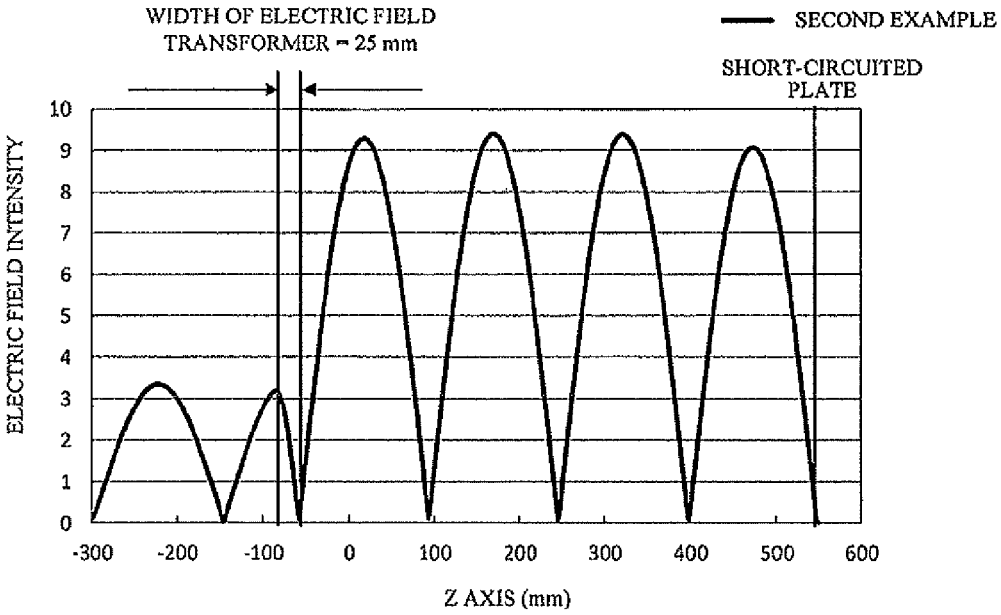
FIG. 8 is a graph showing change in electric field intensity when the electric field transformer is interposed.

FIG. 8 is a graph showing electric field intensity in the heating chamber 5 in Second example. The horizontal axis shows positions in the microwave traveling direction (z axis direction) in the heating chamber 5, and the vertical axis shows electric field intensity. Referring to FIG. 8, the electric field intensity is greatly increased on the downstream side from the electric field transformer 15. In FIG. 8 and FIGS. 9A to 9F, the electric field intensity on the vertical axis has relative values (dimensionless values) when a predetermined value is a reference.

FIGS. 9A to 9F are graphs showing electric field intensity in the heating chamber 5 when the width of the electric field transformer 15 is changed in Example 2. In this example, the dielectric having the same width is interposed directly ahead of a short-circuited plate. This is performed for making the experimental conditions identical, and does not affect the effect of Examples. In addition, depending on the graphs, the magnitude of the electric field intensity in a position at the wave trough of the standing microwave is slightly varied, which is within the calculation error range.

Figure 9A:
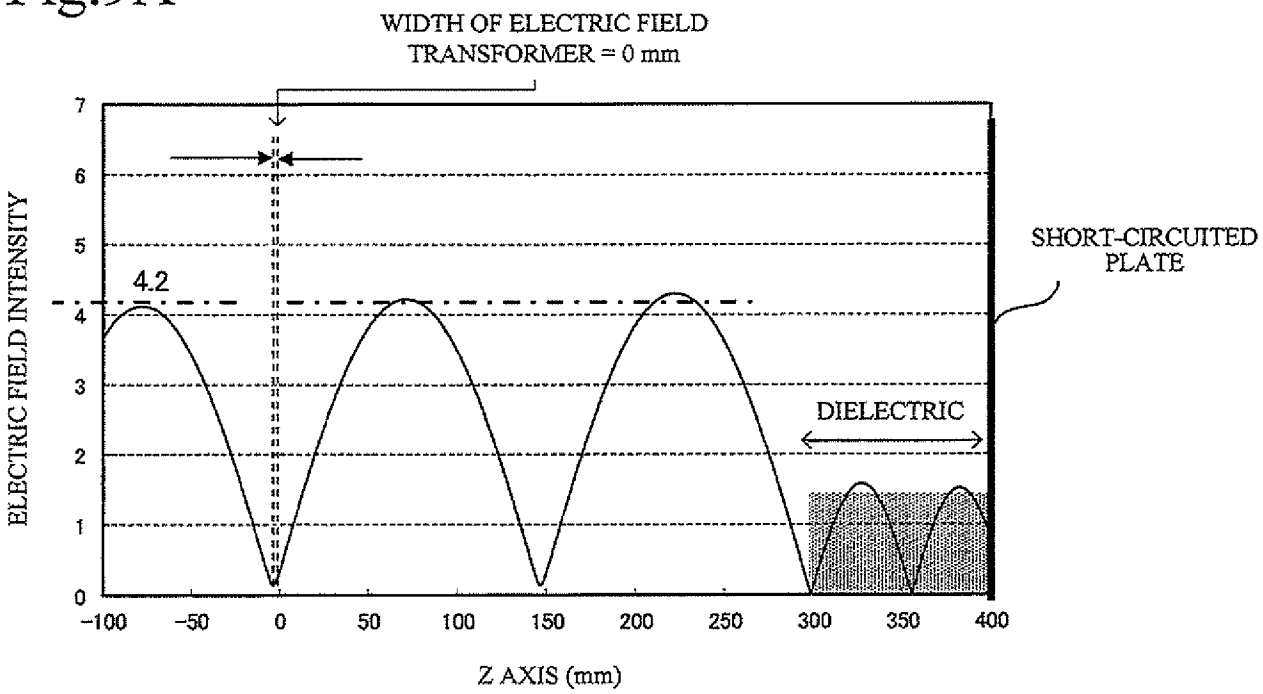
FIG. 9A is a graph showing the waveform of a standing microwave when the electric field transformer is not interposed.
Figure 9B:
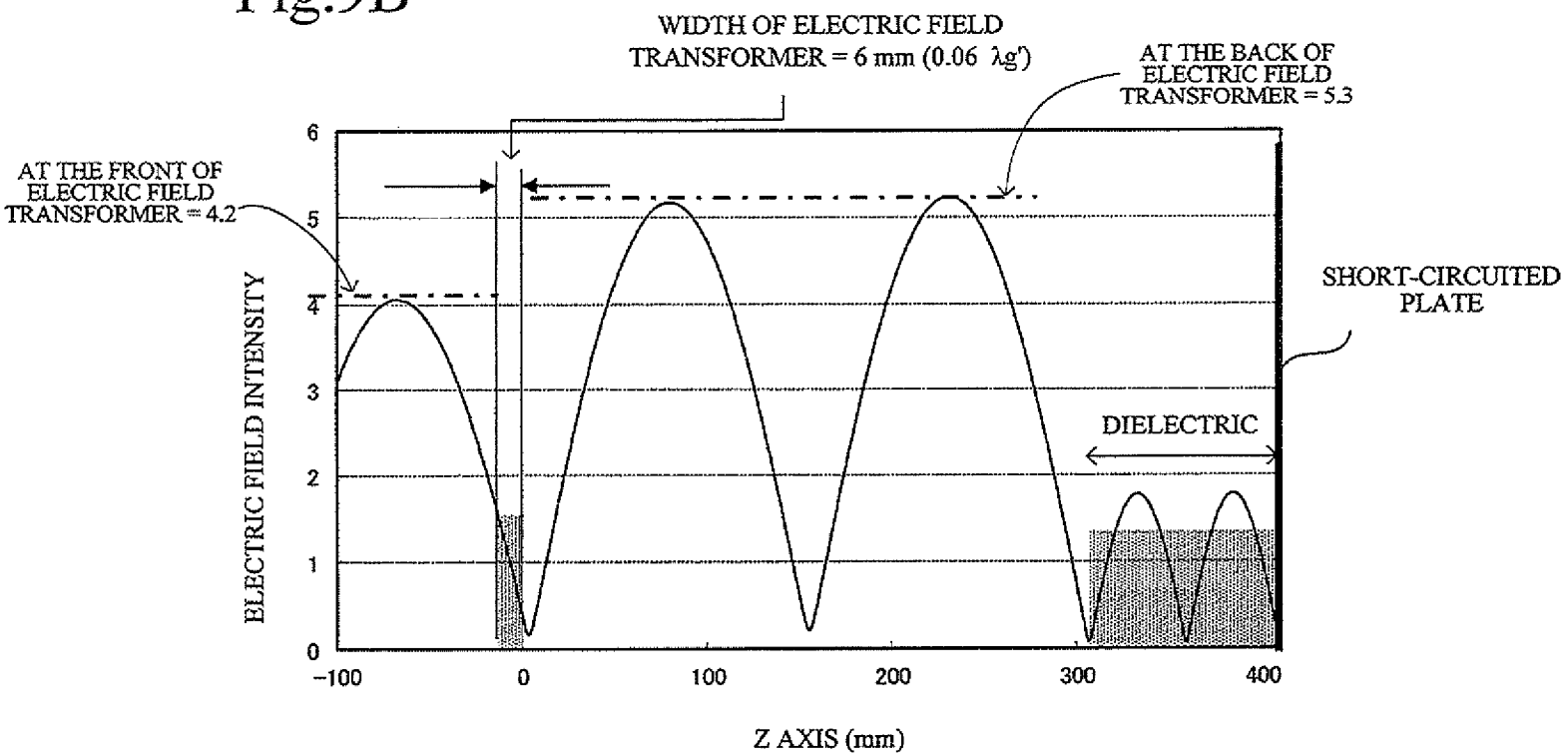
FIG. 9B is a graph showing change in electric field intensity when the electric field transformer having a width of 0.06 $\lambda g'$ is interposed.
Figure 9C:
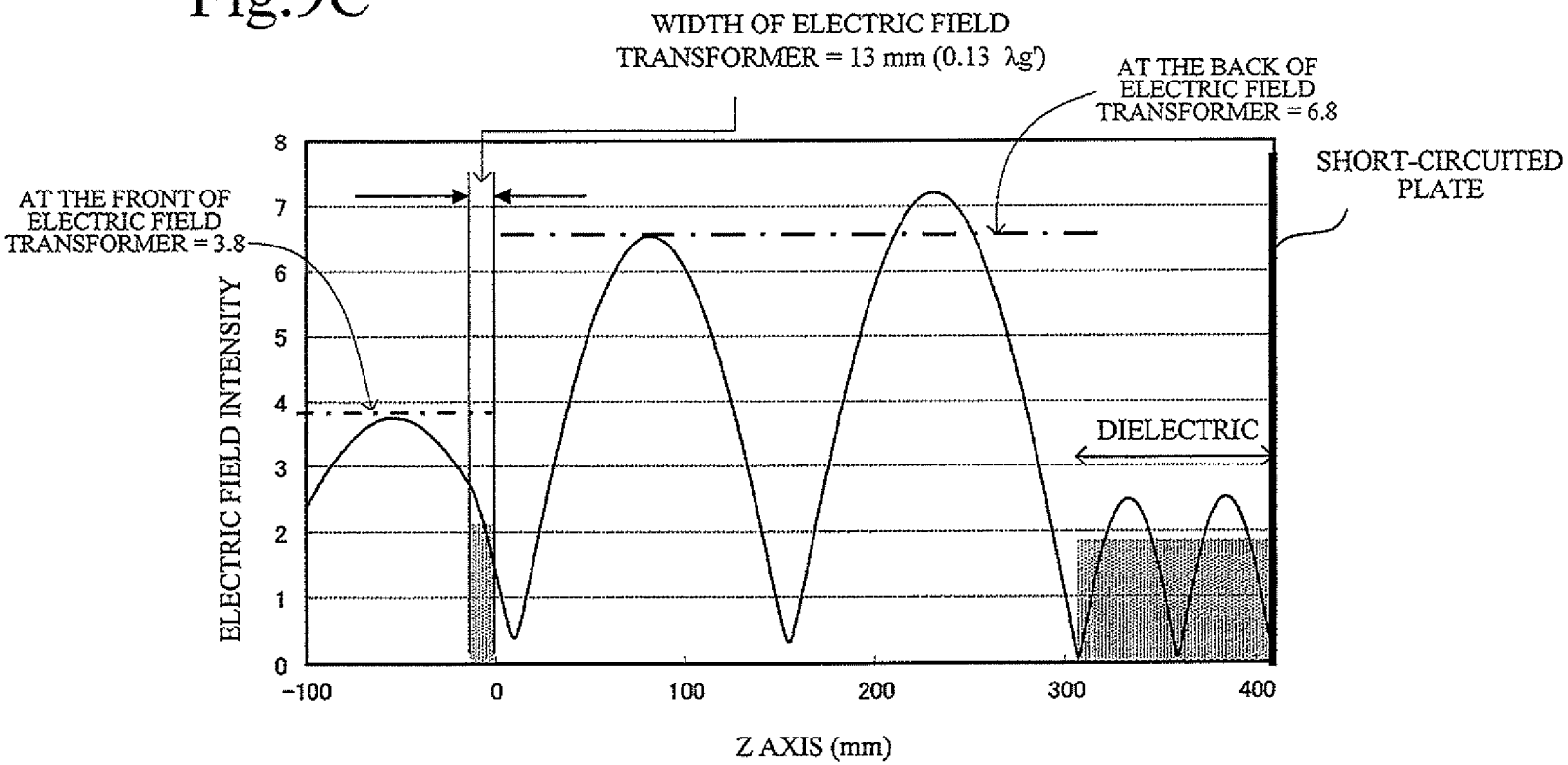
FIG. 9C is a graph showing change in electric field intensity when the electric field transformer having a width of 0.13 $\lambda g'$ is interposed.
Figure 9D:
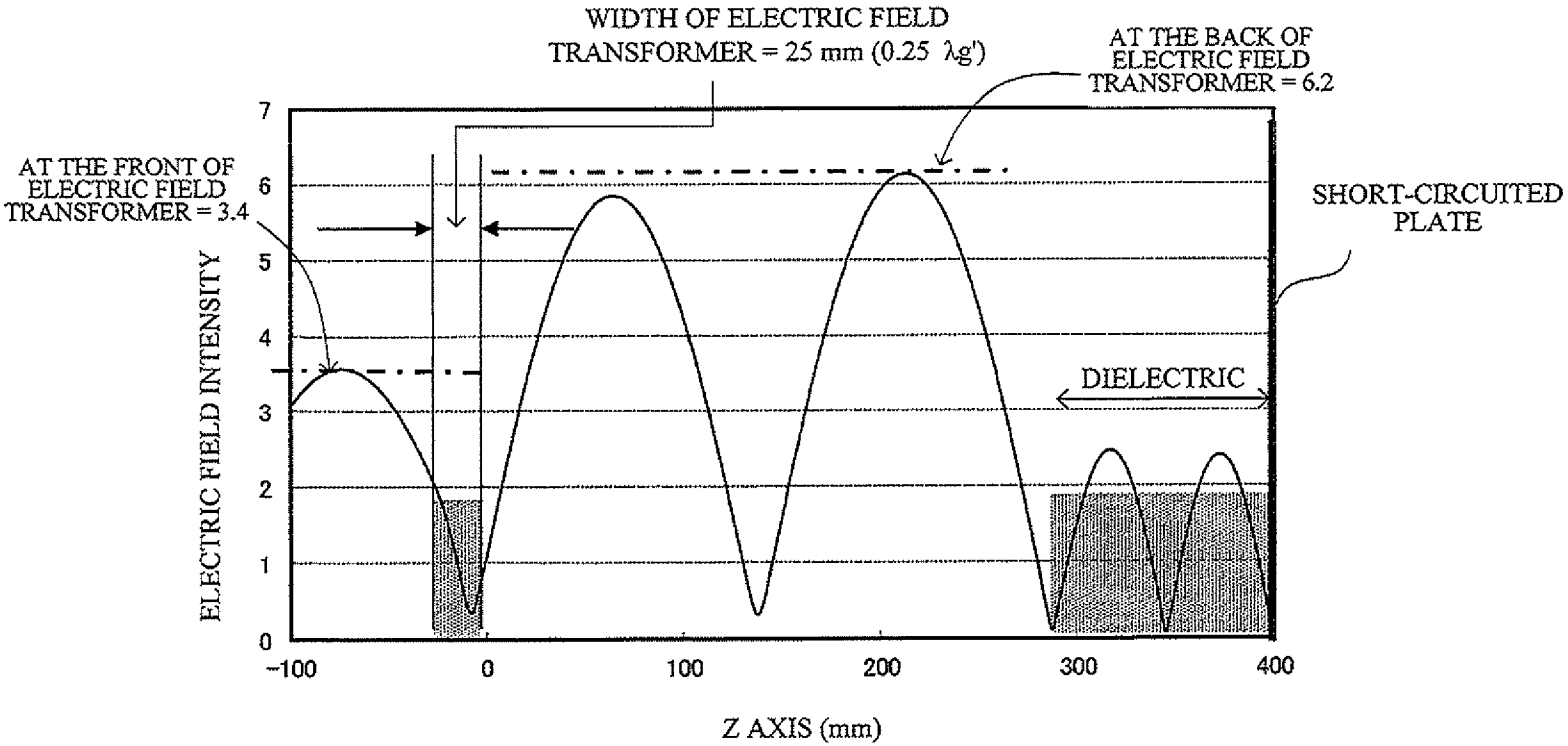
FIG. 9D is a graph showing change in electric field intensity when the electric field transformer having a width of 0.25 $\lambda g'$ is interposed.
Figure 9E:
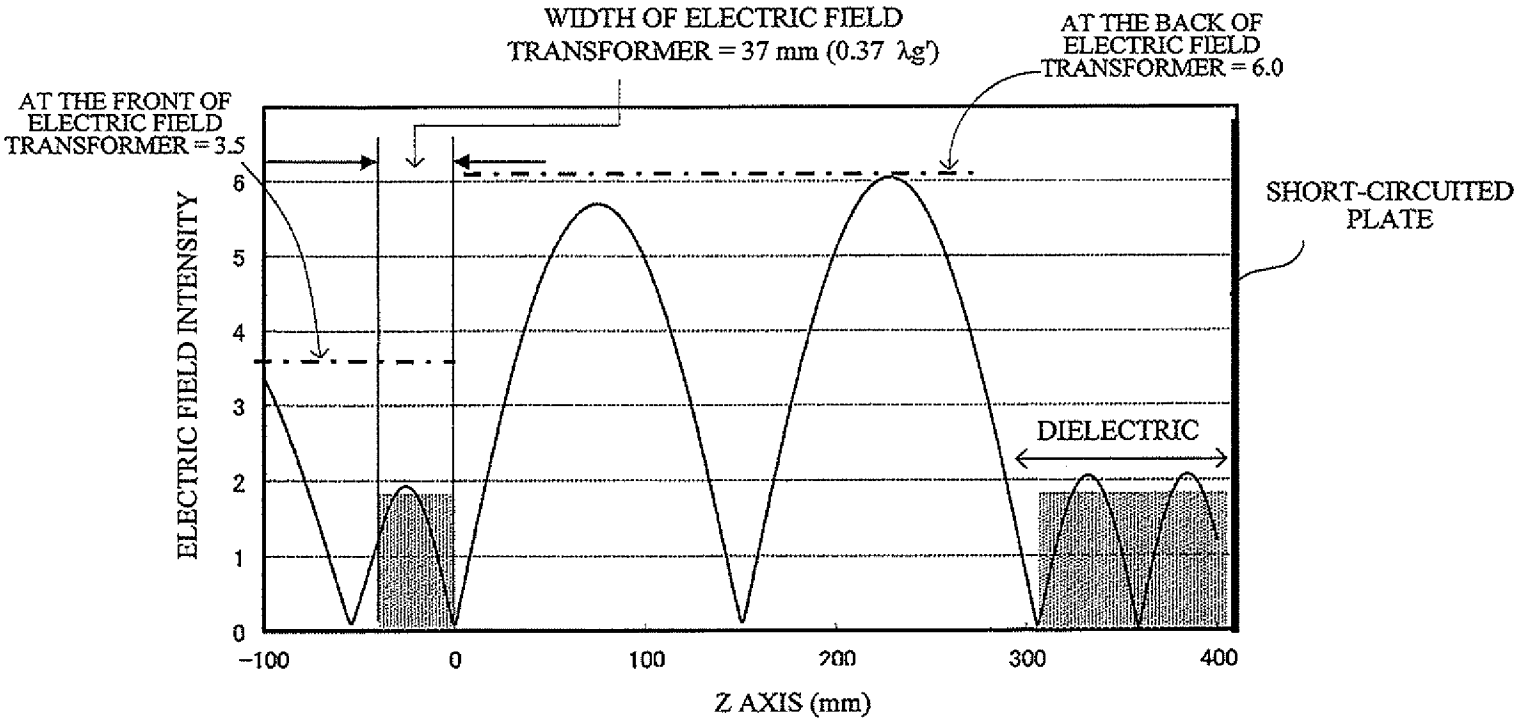
FIG. 9E is a graph showing change in electric field intensity when the electric field transformer having a width of 0.37 $\lambda g'$ is interposed.
Figure 9F:
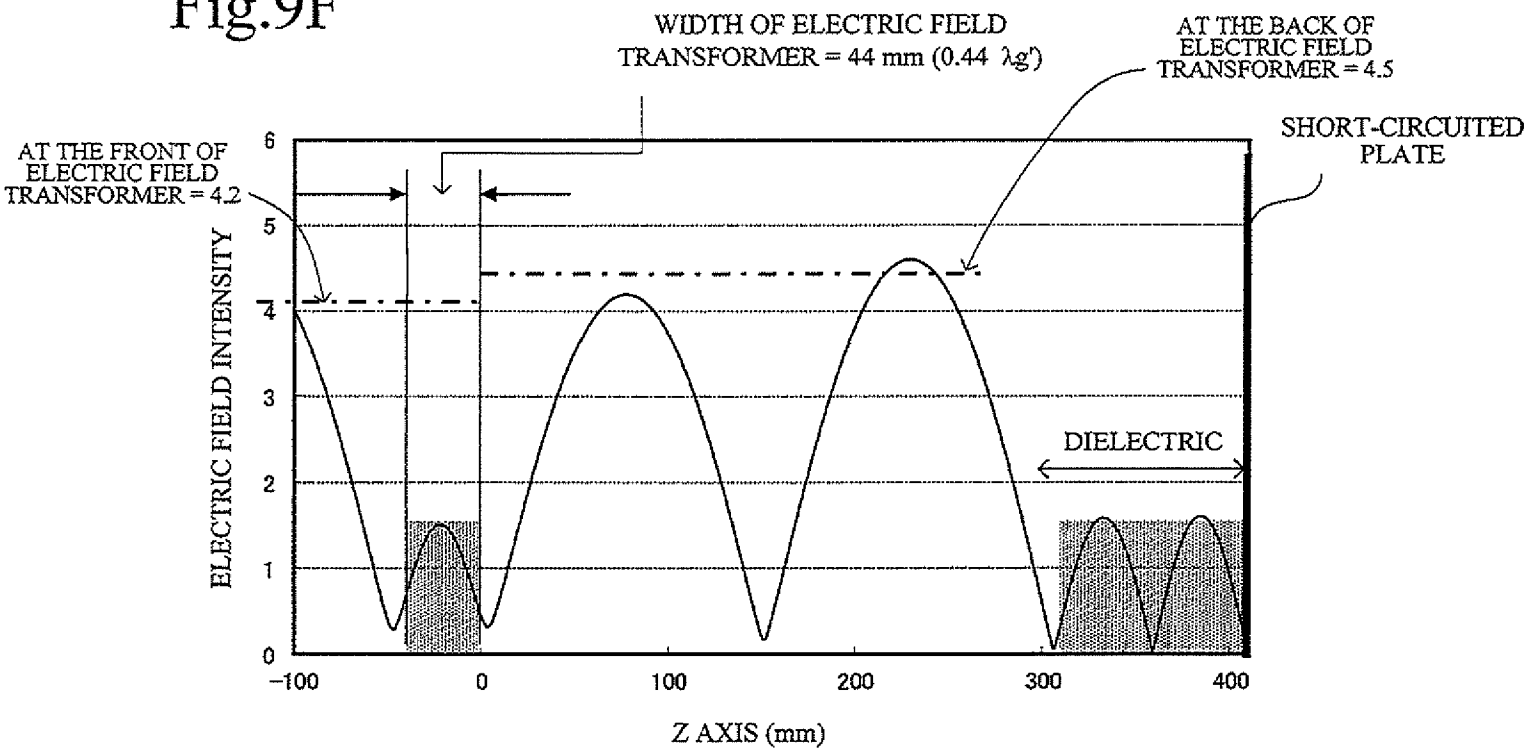
FIG. 9F is a graph showing change in electric field intensity when the electric field transformer having a width of 0.44 $\lambda g'$ is interposed.
Figures 9G, 9H:
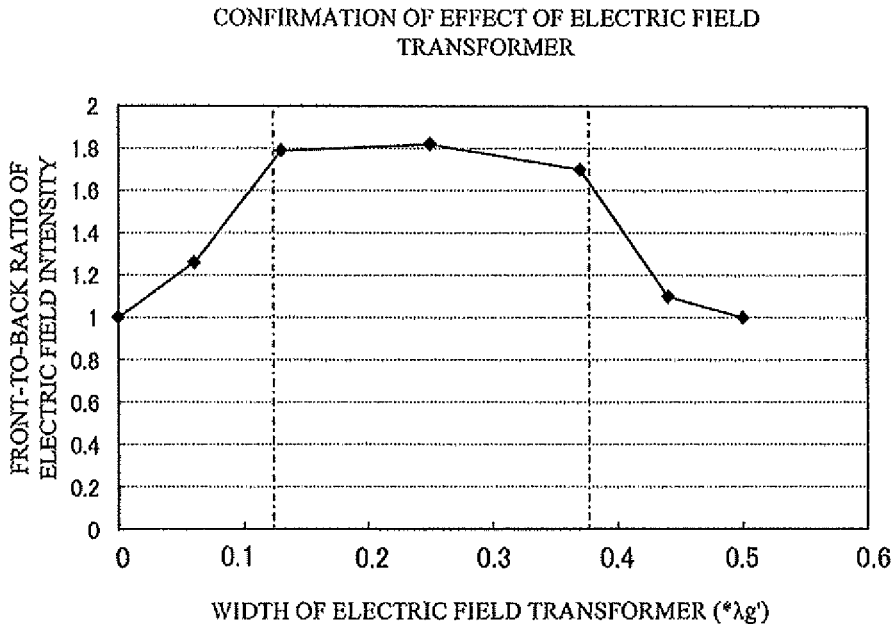
FIG. 9G is a graph showing the relation between the front-to-back ratio of the electric field transformer and the width of the electric field transformer.
FIG. 9H is a table showing the relation between the front-to-back ratio of the electric field transformer and the width of the electric field transformer.

FIG. 9G is a graph showing change in the ratio between the magnitudes of electric field intensities on the upstream side and the downstream side of the electric field transformer 15 when the width of the electric field transformer 15 is changed. FIG. 9H is a table thereof.

FIGS. 9A, 9B, 90, 9D, 9E, and 9F are graphs when the electric field transformer 15 has widths of 0 mm, 6 mm, 13 mm, 25 mm, 37 mm, and 44 mm, respectively.

In FIG. 9A, since the electric field transformer 15 is not interposed, as a matter of course, the electric field intensity is not changed at the front and back of the electric field transformer 15 (electric field intensity=4.2).

In FIG. 9B, the width of the electric field transformer 15 is 6 mm this corresponds to 0.06 λg'). On the upstream side of the electric field transformer 15, the electric field intensity=4.2. On the downstream side of the electric field transformer 15, the electric field intensity=5.3. The electric field intensity is 1.26 times higher at the back than at the front of the electric field transformer 15.

In FIG. 9C, the width of the electric field transformer 15 is 13 mm (this corresponds to 0.13 μg'). On the upstream side of the electric field transformer 15, the electric field intensity=3.8. On the downstream side of the electric field transformer 15, the electric field intensity=6.8. The electric field intensity is 1.79 times higher at the back than at the front of the electric field transformer 15.

In FIG. 9D, the width of the electric field transformer 15 is 25 mm (this corresponds to 0.25 λg'). On the upstream side of the electric field transformer 15, the electric field intensity=3.4. On the downstream side of the electric field transformer 15, the electric field intensity=6.2. The electric field intensity is 1.82 times higher at the back than at the front of the electric field transformer 15.

In FIG. 9E, the width of the electric field transformer 15 is 37 mm (this corresponds to 0.37 λg'). On the upstream side of the electric field transformer 15, the electric field intensity=3.5. On the downstream side of the electric field transformer 15, the electric field intensity=6.0. The electric field intensity is 1.7 times higher at the back than at the front of the electric field transformer 15.

In FIG. 9F, the width of the electric field transformer 15 is 44 mm (this corresponds to 0.44 λg'). On the upstream side of the electric field transformer 15, the electric field intensity=4.2. On the downstream side of the electric field transformer 15, the electric field intensity=4.5. The electric field intensity is 1.1 times higher at the back than at the front of the electric field transformer 15.

Although not shown on the graphs, when the width of the electric field transformer 15 is 50 mm (this corresponds to 0.50 λg'), the upstream end point and the downstream end point of the electric field transformer 15 are both in the position at the wave trough of the standing microwave. Therefore, the electric field intensity is not changed on the downstream side and the upstream side of the electric field transformer 15.

According to the above results, a width L of the electric field transformer 15 is set to satisfy $(4N-3)\lambda g'/8<L<(4N-1)\lambda g'/8$ by using the relational equations, that is, natural number N, so that the electric field intensity of the standing microwave on the downstream side of the electric field transformer 15 can be higher. Accordingly, the electric field intensity in the heating chamber 5 can be higher to greatly shorten time necessary for toner fusion.

What is claimed is:

1. A microwave heating device comprising:

a microwave generating portion outputting a microwave;

a conductive heating chamber into which the microwave is led and having a short-circuited terminal end in a traveling direction of the microwave;

a tuner provided between the microwave generating portion and the heating chamber; and an electric field transformer which is a high dielectric having a higher dielectric constant than air, the transformer having a width more than $(4N-3)\lambda g'/8$ and less than $(4N-1)\lambda g'/8$ where $\lambda g'$ is the wavelength of a standing microwave in the high dielectric and N (N>0) is a natural number, the transformer being interposed in a position including a node of the standing microwave between the tuner and the heating chamber, wherein the heating chamber has an opening for passing a member to be heated therethrough in the heating chamber in a direction non-parallel to the traveling direction of the microwave, the tuner re-reflects the microwave reflected at the terminal end of the heating chamber onto the heating chamber side, the microwave output end of the microwave generating portion and the tuner are connected by a first square tubular waveguide made of a conductive material, and the tuner and the terminal end of the heating chamber are connected by a second square tubular waveguide, the waveguide being made of a conductive material except for the opening for passing the member to be heated therethrough.

2. The microwave heating device according to claim 1, wherein the tuner is an E-H tuner.

3. The microwave heating device according to claim 1, wherein the electric field transformer has a width which is an odd multiple of $\lambda g'/4$, and is provided such that a surface of the heating chamber on the terminal end side is in a position at the node of the standing microwave.

4. The microwave heating device according to claim 1, wherein the electric field transformer is made of ultra high molecular weight polyethylene.

5. An image fixing apparatus comprising:

the microwave heating device according to claim 1, wherein a recording sheet with developing particles passes through the opening and is heated in the heating chamber, thereby fusing the developing particles onto the recording sheet.

6. A microwave heating device comprising:

a microwave generating portion outputting a microwave;

a conductive heating chamber into which the microwave is led and having a short-circuited terminal end in a traveling direction of the microwave;

a tuner provided between the microwave generating portion and the heating chamber, configured to re-reflect the microwave reflected at the terminal end of the heating chamber onto the heating chamber side;

an opening provided on the heating chamber for passing a member to be heated therethrough in the heating chamber in a direction non-parallel to the traveling direction of the microwave;

a first square tubular waveguide connected to a microwave output end of the microwave generating portion and the tuner, made of a conductive material;

a second square tubular waveguide connected to the tuner and the terminal end of the heating chamber, made of a conductive material except for the opening for passing the member to be heated therethrough; and an electric field transformer which is a high dielectric having a higher dielectric constant than air, the transformer having a width more than $(4N-3)\lambda g'/8$ and less than $(4N-1)\lambda g'/8$ where $\lambda g'$ is the wavelength of a standing microwave in the high dielectric and N (N>0) is a natural number, the transformer being interposed in a position including a node of the standing microwave between the tuner and the heating chamber.

7. The microwave heating device according to claim 6, wherein the electric field transformer has a width which is an odd multiple of $\lambda g'/4$, and is provided such that a surface of the heating chamber on the terminal end side is in a position at the node of the standing microwave.

8. The microwave heating device according to claim 6, wherein the electric field transformer is made of ultra high molecular weight polyethylene.

9. An image fixing apparatus comprising:

the microwave heating device according to claim 6, wherein a recording sheet with developing particles passes through the opening and is heated in the heating chamber, thereby fusing the developing particles onto the recording sheet.

10. A microwave heating device comprising:

a microwave generating portion outputting a microwave;

a conductive heating chamber into which the microwave is led and having a short-circuited terminal end in a traveling direction of the microwave;

an E-H tuner provided between the microwave generating portion and the heating chamber, configured to re-reflect the microwave reflected at the terminal end of the heating chamber onto the heating chamber side;

an opening provided on the heating chamber for passing a member to be heated therethrough in the heating chamber in a direction non-parallel to the traveling direction of the microwave;

a first square tubular waveguide connected to a microwave output end of the microwave generating portion and the E-H tuner, made of a conductive material;

a second square tubular waveguide connected to the E-H tuner and the terminal end of the heating chamber, made of a conductive material except for the opening for passing the member to be heated therethrough; and an electric field transformer which is made of ultra high molecular weight polyethylene, the transformer having a width more than $(4N-3)\lambda g'/8$ and less than $(4N-1)\lambda g'/8$ where $\lambda g'$ is the wavelength of a standing microwave in the high dielectric and N (N>0) is a natural number, the transformer being interposed in a position including a node of the standing microwave between the E-H tuner and the heating chamber.

11. The microwave heating device according to claim 10, wherein the electric field transformer has a width which is an odd multiple of $\lambda g'/4$, and is provided such that a surface of the heating chamber on the terminal end side is in a position at the node of the standing microwave.

12. An image fixing apparatus comprising:

the microwave heating device according to claim 10, wherein a recording sheet with developing particles passes through the opening and is heated in the heating chamber, thereby fusing the developing particles onto the recording sheet.

* * * * *